US012171335B1

(12) United States Patent
Norton

(10) Patent No.: US 12,171,335 B1
(45) Date of Patent: Dec. 24, 2024

(54) APPARATUS FOR RAPID DEPLOYMENT OF A FIREARM

(71) Applicant: Richard Norton, Cypress, TX (US)

(72) Inventor: Richard Norton, Cypress, TX (US)

( * ) Notice: Subject to any disclaimer, the term of this patent is extended or adjusted under 35 U.S.C. 154(b) by 0 days.

(21) Appl. No.: 17/984,782

(22) Filed: Nov. 10, 2022

(51) Int. Cl.
*A47B 81/00* (2006.01)

(52) U.S. Cl.
CPC ..... *A47B 81/005* (2013.01)

(58) Field of Classification Search
CPC . A47B 81/005; E05B 47/0038; E05B 47/004; E05B 47/0043; E05B 47/0045; E05C 17/56; E05C 19/16
USPC ..... 70/78
See application file for complete search history.

(56) References Cited

U.S. PATENT DOCUMENTS 3,736,779 A * 6/1973 Pratt ..... E05B 47/0038 70/276
4,309,065 A 1/1982 Pappas
4,452,371 A * 6/1984 Jurek ..... B60S 5/00 70/56
4,741,454 A * 5/1988 Ray ..... E05C 19/003 292/259 R
4,936,038 A * 6/1990 Johnson ..... A47B 81/005 42/106
5,118,175 A 6/1992 Costello
5,485,733 A * 1/1996 Hoffman ..... E05B 65/46 70/276
5,916,087 A 6/1999 Owens
5,987,941 A 11/1999 Zocco
6,405,861 B1 * 6/2002 Siler ..... F41C 33/06 206/1.5
6,843,081 B1 1/2005 Painter
7,178,370 B2 2/2007 Engel
8,104,313 B2 1/2012 Wolfe
8,430,461 B1 * 4/2013 Cole ..... A47B 81/005 312/204
8,506,023 B2 8/2013 Goldie
8,756,961 B2 * 6/2014 Qiu ..... E05C 9/002 70/79
9,560,918 B2 2/2017 Edwards
9,963,927 B1 * 5/2018 Dudley ..... E05G 1/026
10,180,303 B2 * 1/2019 Gilbert ..... B65D 43/22
10,472,879 B1 * 11/2019 Galler ..... E05B 53/00
2010/0212372 A1 * 8/2010 Wolfe ..... A47B 81/00 206/317
2012/0067090 A1 * 3/2012 Varney ..... E05B 65/46 70/81
2014/0103785 A1 * 4/2014 Richards ..... E05G 1/024 312/204

(Continued)

OTHER PUBLICATIONS

Office Action in Unpublished U.S. Appl. No. 16/435,223 with Notification Date of Oct. 1, 2019.

(Continued)

*Primary Examiner* — Daniel J Rohrhoff
(74) *Attorney, Agent, or Firm* — Compton & Associates PLLC; Matthew Compton

(57) ABSTRACT

An apparatus for secured concealment of a firearm allowing rapid deployment of same. A firearm is conveniently stored in a secure location while being concealed from view. The firearm may be quickly retrieved by releasing or triggering a mechanism which rapidly deploys the firearm to a position in which the grip is projected outward from the concealed location for an ambidextrous draw.

8 Claims, 9 Drawing Sheets

(56) References Cited

U.S. PATENT DOCUMENTS

| | | | | |
|---|---|---|---|---|
| 2016/0223290 | A1* | 8/2016 | Jacob | F41C 33/06 |
| 2019/0257121 | A1* | 8/2019 | Tubby | E05B 65/5223 |
| 2021/0267373 | A1* | 9/2021 | Steere | A47B 88/60 |
| 2021/0378399 | A1* | 12/2021 | Hackl | A47F 3/002 |
| 2022/0042767 | A1* | 2/2022 | Cosico | G07C 9/00563 |
| 2022/0167743 | A1* | 6/2022 | Dunn | A47B 46/005 |
| 2023/0258426 | A1* | 8/2023 | Johannes | B60R 7/14 211/64 |
| 2023/0276943 | A1* | 9/2023 | Dillon | A47B 81/005 109/59 R |

OTHER PUBLICATIONS

Rick Norton, Rapid Weapon Deployment Systems, Website Product Images from Prior Model, 2019, one or more of which were previously available at https://rwdsystems.com/, USA.

* cited by examiner

APPARATUS FOR RAPID DEPLOYMENT OF A FIREARM

FIELD OF THE INVENTION

The present invention generally relates to the field of firearm storage and deployment.

BACKGROUND OF THE INVENTION

Storage and concealment of a firearm and particularly storage in a home or office setting where rapid accessibility may be required may in some circumstances be necessary for protection purposes.

Burglaries, invasions, and assaults are credible security threats which some choose to protect against by possessing firearms. Safe storage laws require owners to responsibly store firearms and ammunition, when not in use, in a manner that prevents unauthorized use.

Many firearm owners struggle with how to maintain quick access to their firearm, while restricting access to others around them. Storage device options include trigger locks, biometric locks, gun cases, strong boxes, gun cabinets, and gun safes.

Trigger locks, gun cases, cabinets, and safes offer strong protection, but can physically delay access and functionality of a firearm in emergency situations. Biometric locks attempt to alleviate some of the delay, but can fail when fingers are sweaty, covered in blood, and/or other environmental conditions common to emergency situations.

Additionally, those same environmental conditions as well as adrenaline fueled physical actions and heightened mental state may make the physical retrieval difficult. In an emergency one does not want to "fumble a firearm," displace a magazine, or get an improper grip. Any one of these can affect aim, mental processes, or cause firearm malfunctions during a critical situation.

Hiding a firearm in an out of the way location, such as a bedroom closet, may secure the firearm, but makes retrieval difficult or impossible in some situations. Using furniture to hide a firearm, such as in a drawer or on a high shelf, allows easy access in an emergency. But this may leave the firearm exposed to unauthorized users or result in unnecessary interaction which could result in accidental discharge.

What is desired is a method of storage that places a firearm close-at-hand for emergency deployment, but secures it safely out of sight, and allows quick and easy retrieval in an emergency. The firearm should typically be retrievable with dominant or non-dominant hands without requiring the delay of having to reposition one's grip.

SUMMARY OF THE INVENTION

An embodiment of the present invention concerns a concealable storage system for a handgun, which upon activation, rapidly presents the handgun to a user for quick ambidextrous retrieval. The handgun may be stored in a biased kinetic potential position such that when released, the weight of the firearm rotates and pivots the firearm to a generally horizontally oriented position (i.e., a horizontal position that is between +25 through −25 degrees from the perfectly horizontal position) and outwardly presenting the grip away from interference for ambidextrous drawing of the firearm.

In a preferred embodiment, the concealable storage system encloses and visually obscures a gun in a stored position. The gun is secured to a gun mount of an action block within a frame with a movable front panel. The gun is positioned barrel down, with the grip rotated to a side of the frame. This causes the center of mass of the firearm to be above and to one side of the deployed position/orientation. Thus the gun is secured to the gun mount by the barrel such that the grip may remain unobstructed.

The front panel of the concealable storage system houses a picture, a painting, or etched or stained or painted glass, or a mirror to obscure the firearm stored therein. Etched or stained-glass embodiments of the concealable storage system may also comprise a source of lighting within the frame to backlight and explain/account for the depth behind the front panel. An example may include, but not be limited to LEDs or low voltage incandescent bulbs. In another embodiment, the frame may be recessed into a supporting wall such that the front panel appears as a flat hanging picture.

To remove the firearm from storage, the front panel is released or removed allowing the guns to transition to a deployed position for ambidextrous draw by a user. The front panel may be hinged to swing open, and may be secured by a catch, lock, clasp, or in other manners. In an alternative embodiment, the front panel may be slidably mounted to the frame so it may slide toward one edge of the frame releasing the stored firearm within. In another embodiment, the front panel may be secured to the frame in a removeable fashion such that it is easily removable from the secured position releasing the stored firearm within the frame. Examples may include, but are not limited to magnetic catches, hooks, hook and loop fasteners (e.g., Velcro™), or adhesive.

The gun mount allows a secured gun to rotate freely around the central axis of the barrel. The mount is pivotally attached to the action block near the end distal to the grip of a secured gun, such that it may pivot toward the direction of the front panel.

In some embodiments, a dampener is positioned within the action block to bias the pivot of the mount.

A gun secured to the mount in a stored position, is constrained in a kinetically biased configuration, by the frame, particularly the front panel of said frame. When released, the gun provides sufficient weight to the mount such that the mount pivots to an approximately horizontal position, and the center of mass of the gun rotates the gun's grip to extend downward below the mount, thus ending in a deployed position.

In an alternative embodiment, the gun secured to the mount may be stored in a stable kinetically biased configuration and is urged to an unstable kinetically biased position by a catch or pull configured to move the gun in the direction of the movement of the front panel upon release.

When transitioning between the stored position and the deployed position, the dampener exerts force on the mount to counter gravity's effect on the weight of the gun so that the firearm quickly, but smoothly transitions without undue shock or reaction (bounce) that could cause damage to the gun or unintentionally disengage it from the mount.

The dampener may be a pneumatic or fluid shock absorber, a mechanical spring, or a compressible solid material. Alternatively, the effects of dampening may be accomplished by friction affecting the action of the pivot joint. In one embodiment, an adjustable pneumatic shock absorber provides dampening actions and is calibrated to the weight of the gun and ammunition.

One skilled in the art could understand the use of other dampening methods, and that they could be predetermined based on anticipated use to prevent the need of adjustments. In an alternative, a spring is captured between a dampener cap and a lower adjustment along a shaft. The lower adjustment is moved up or down to increase or decrease the expansion area of the spring thus adjusting the force the spring exerts on the cap during compression caused by the pivoting of the action blocks mount base during movement of a gun's deployment.

In an alternative embodiment, a spring provides dampening action, and may be adjusted by use of an adjustable lower mount configured for pre-compression of and to increase resistive force to the compression means exerted during transition. If dampening forces are too high for the gun and ammunition weight, the gun may not fully deploy and remain in a position undesirably (for some circumstances) angled above horizontal. If dampening forces are too low for the gun and ammunition weight, the gun may impact the action block stop and bounce/reverberate, or potentially expend the energy by breaking the mount, or marring the barrel.

While the deployed position is described above as horizontal, and extending outward from the frame, one skilled in the arts would appreciate that a deployed position may be specific to user preference, situation, environment. This can be accomplished by configuration of action stops for pivoting of the mount, dampener action/forces, the pivoting angle of the mount, or the angling of the action block within the frame.

A preferred embodiment comprises a frame, having a depth sufficient to accommodate the desired handgun. The relation of the rear panel to the action block and mount are such that a stored firearm is unstably biased toward the front panel. A preferred embodiment includes a hinged front panel which has a mechanical latch, catch, lock, or magnet(s) securing the door in the closed position until intentionally released.

In some embodiments, a physical object such a block of wood, plastic, rubber, felt pad, or other material may be mounted to (or alternatively, be formed by) the rear panel which prevents a stored firearm from entering a stable position or being biased away from the front panel. In another embodiment, a stored gun's position may be stable, or may be biased in another direction, and a mechanical action utilized to urge the deployment action by providing a force toward the front panel direction. The mechanical action may include, but not be limited to a compressible material on the rear panel, or a physical catch extending from the front panel toward the rear panel which curves behind a stored firearm. The mechanical action may be caused by opening the front panel, or may be caused by other user action, which may subsequently cause the opening of the front panel.

Typically, the mount for the gun must reliably secure the gun during deployment actions, not interfere with drawing, and must do so from the barrel end such that it does not extend to a point of interference with grip presentation. One skilled in the arts would appreciate that various mounting methods would meet these requirements, and some may incorporate additional actions or requirements to disengage the gun from the mount, all of which are in accordance with the innovation described herein.

In some embodiments, the mount may comprise a barrel pin or a holster as further described below. In one embodiment, a holster is changeably attached to a mount base, the holster configured to secure around the gun barrel. In one embodiment, the holster may extend as far as the end of the trigger guard nearest the grip to prevent finger placement on the trigger prior to drawing. In another embodiment the holster is form fitted to the gun. In another embodiment, the holster is magnetic.

In one embodiment, the barrel pin is a round rod which slides into the gun barrel and is shaped at the protruding end to form a base which is pivotally mounted to the action block. In one embodiment, the barrel pin and base of the mount are a single piece of machined plastic, fiberglass, or metal material. In the case of metal, it is typically preferable to further coat the material in polytetrafluoroethylene (PTFE) (e.g., Teflon™), other plastics, elastic, or epoxy to prevent possible marring of the gun barrel.

In another embodiment, the barrel pin and the mount base are separate components. The base preferably being either metallic or a sturdy plastic (e.g., polyoxymethylene, sometimes called Delrin®) and comprising a threaded recess for receiving a barrel pin. The barrel pin being radially sized to correspond to the bore diameter of the barrel, which is determined by the gun caliber. The barrel pin length being determined by the barrel length, and the desire to allow or prevent mounting of the gun with a round of ammunition chambered. The barrel pin is preferably made from carbon fiber, but sturdy plastics or metals may be used also.

In some embodiments, the barrel pin is a machined tube of nylon having a central bore counter-sunk or further recessed for receiving a lag screw to changeably connect, through a muzzle rest to the mount base. The muzzle rest is a disk-shaped padding material with a central hole which the muzzle rest against when oriented to the stored position.

In some embodiments, the lag screw aids in free rotation of the barrel pin on the mount, and the nylon material in contact with the barrel bore of the gun, along with the muzzle rest prevent marring of the gun during storage, deployment, and drawing by aiding free rotation of the gun and smooth drawing from the mount.

In an alternative embodiment, the frame may be attached to the front panel, or the front panel and frame may be a single component. In such an embodiment, the action block is secured to the rear panel, and the framed front panel is hinged to the rear panel. In another embodiment, the action block is attached to the wall, and the front panel/frame is positioned over the action block and weapon to conceal it them from view.

DETAILED DESCRIPTION

Figure 1A:
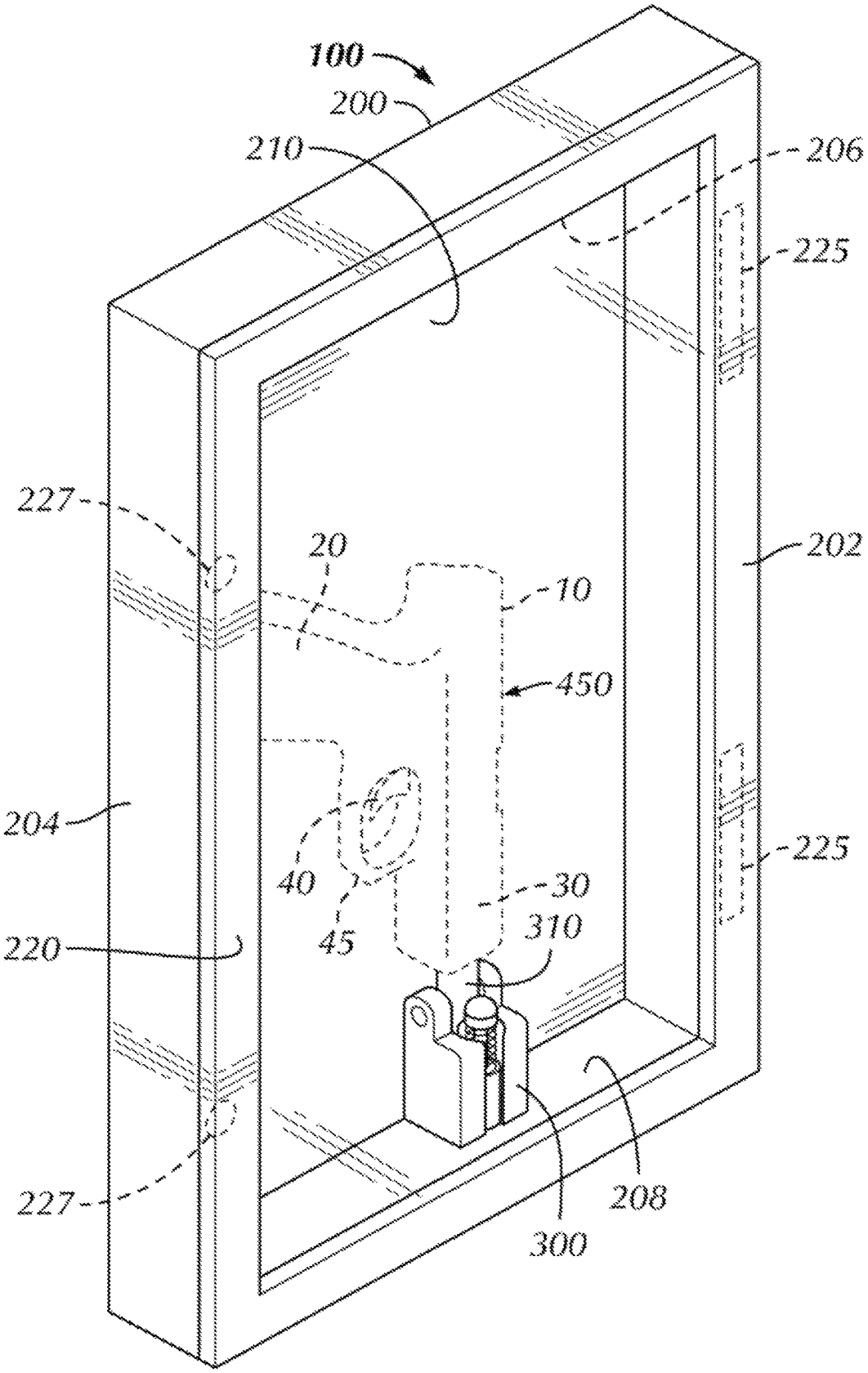
FIG. 1A shows a gun, in phantom, stored in an embodiment of a concealable storage system in accordance with an exemplary embodiment.

FIG. 1A shows a gun, in phantom, stored in a concealable storage system in accordance with an exemplary embodiment. The concealable storage system (100) comprises a boxed frame (200) with sides: top (206), bottom (208), right (202) and left (204) of sufficient width to fit a gun/weapon/firearm (10) between the rear panel (210) and the front panel (220). While a boxed frame (200) is shown with respect to these and other embodiments, the shape of the frame may vary and may round, oval, a regular polygon, an irregular polygon, or an irregular shape.

In the embodiment illustrated, the front panel (220) is mounted to one side (202) of the frame (200) by hinges (225) and secured in a closed position by fasteners (227) on the distal side (204) of the frame. The firearm (10) is held in a stored position (450) oriented barrel (30) down by a gun mount (310) of an action block (300) mounted on the bottom of the frame (208).

The firearm's (10) trigger and guard (40, 45) are rotated such that the center of mass of the firearm, and the magazine (23, not indicated) of ammunition (25, not indicated) in the grip (20) is to one side (204, or 202) of the mount (310), and angled slightly toward the front panel (220). This stored position (450) has a biased kinetic potential such that when released (420, not shown) by removal of the front panel (220), gravity will cause the deployment actions of rotating (430) and pivoting (440) the gun (10) into a deployed position (460, not shown).

Figure 1C:
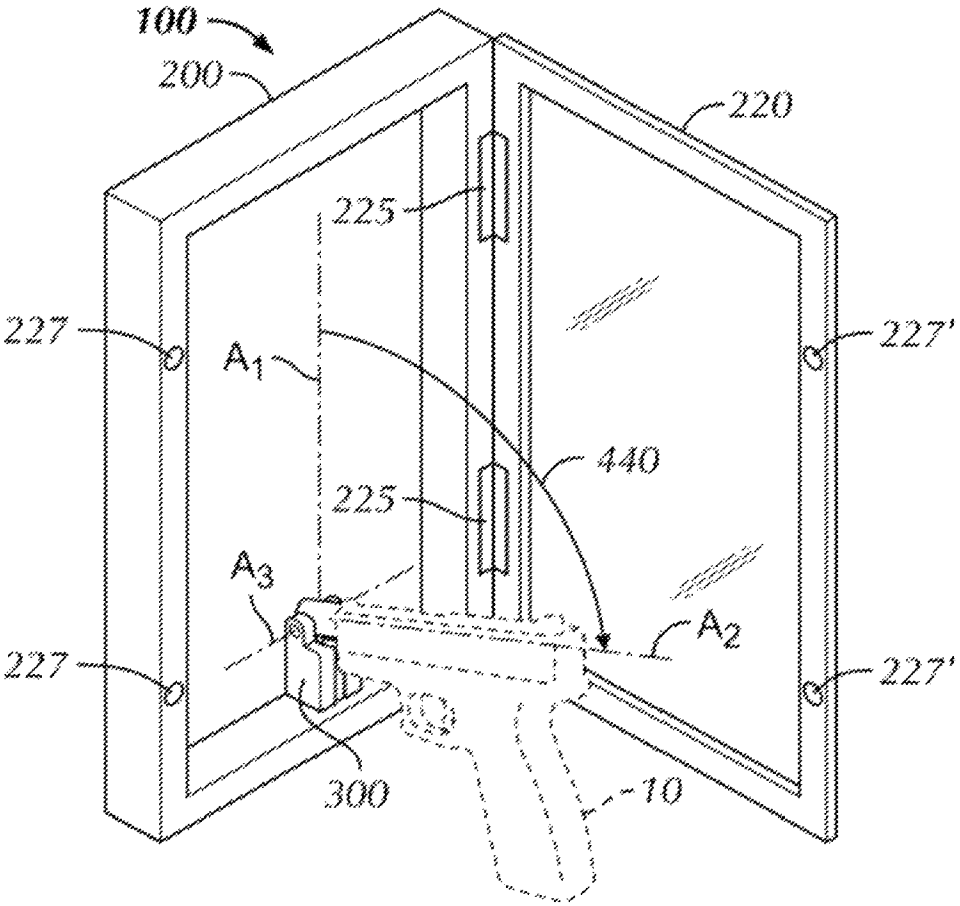
FIG. 1C illustrates a portion of the motion (described as pivot) occurring upon deploying a gun from a concealable storage system in accordance with an exemplary embodiment.
Figure 1B:
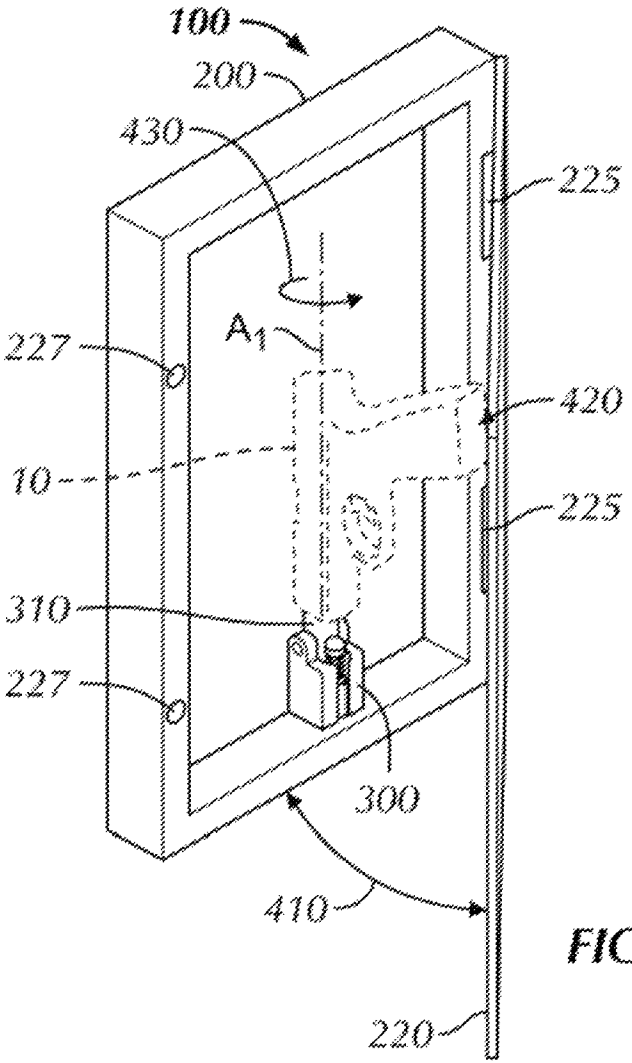
FIG. 1B illustrates a portion of the motion (described as rotate) occurring upon deploying a gun from a concealable storage system in accordance with an exemplary embodiment.

FIG. 1B illustrates a portion of the motion (described as rotate) occurring upon deploying a gun from a concealable storage system in accordance with an exemplary embodiment. The concealable storage system (100) is activated (410) by releasing the latches (227) of the front panel (220) of the boxed frame (200) which removes the front panel (220) from a position constraining the gun (10). In this case by swinging open by the hinges (225). Once released (420) gravity causes the gun's (10) center of mass to rotate (430) on the mount (310) of the action block (300) as the firearm is deployed. This rotation is about the axis $A_1$ of the mount (310).

FIG. 1C illustrates a portion of the motion (described as pivot) occurring upon deploying a gun from a concealable storage system in accordance with an exemplary embodiment. The concealable storage system (100) is activated (410, previous FIG.) by releasing the latches (227, 227') of the front panel (220) of the boxed frame (200) which swings open on the hinges (225). Once released gravity causes the gun's (10) center of mass to rotate about axis $A_1$ on the mount and simultaneously pivot (440) about axis $A_3$ on the action block (300) moving the gun from $A_1$, downward toward position $A_2$.

Figure 1E:
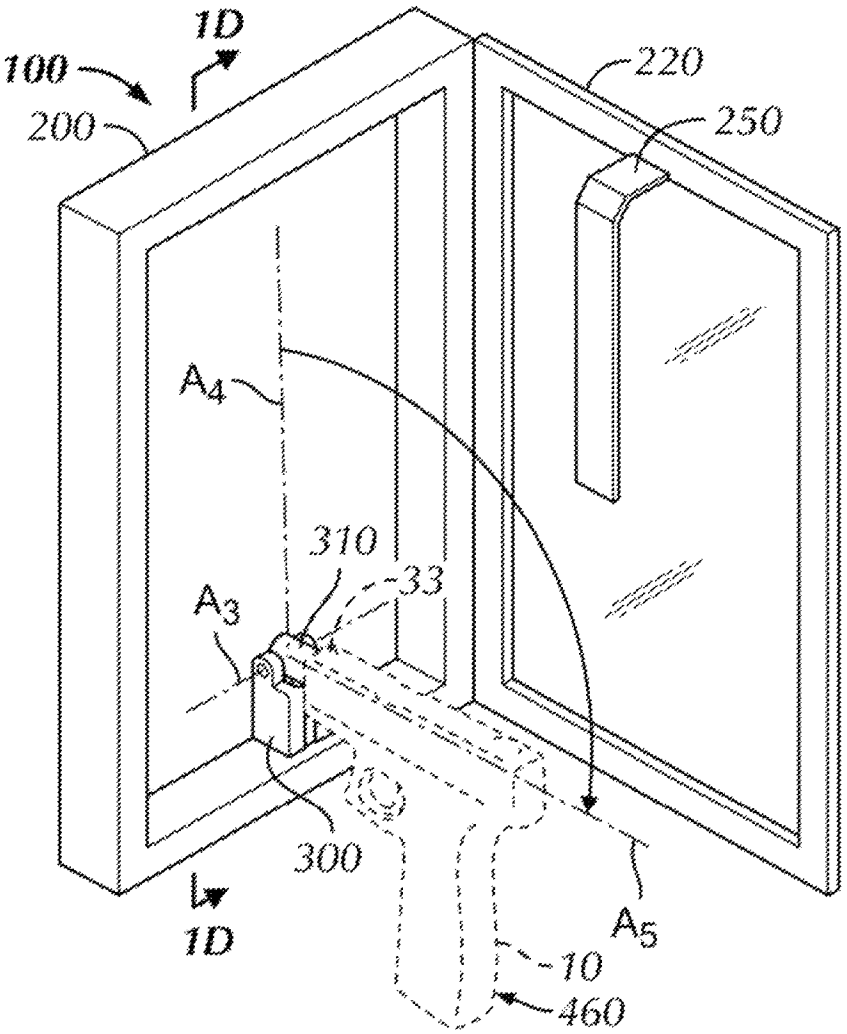
FIG. 1E shows a gun, in phantom, deployed from an embodiment of a concealable storage system in accordance with an exemplary embodiment.
Figure 1D:
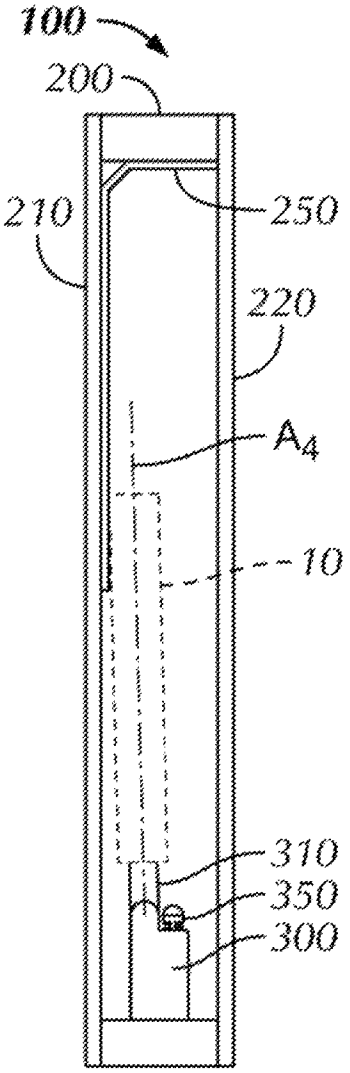
FIG. 1D shows a side cross section of a gun, in phantom, stored in an embodiment of a concealable storage system in accordance with an exemplary embodiment.

FIG. 1D shows a side cross section of a gun, in phantom, stored in a concealable storage system in accordance with an exemplary embodiment. In this alternative embodiment of the concealable storage system (100), the boxed frame (200) may be wider than the firearm (10). This allows the action block (300) to be positioned slightly forward of the rear panel (210). This may cause latches (227, not shown) to be optional.

In the embodiment shown, a catch or pull (250) attached to the front panel (220) extends to the rear panel (210) such that the pull (250) is between the gun (10) and the rear panel (210). The gun (10) is angled from a vertical position such that it rests against the rear panel (210) as illustrated by the center axis $A_4$. Opening the front panel (220) moves the pull (250) forward urging the gun (10) forward so the mount (310) pivots forward toward the dampener (350).

FIG. 1E shows a gun, in phantom, deployed from a concealable storage system in accordance with an exemplary embodiment. In the illustrated embodiment of the concealed storage system (100), the front panel (220) has been moved from the boxed frame (200), and the catch or pull (250) urged the gun (10) forward.

Once the firearm (10) is urged from the stored position (450, not shown) past the vertical position, gravity causes it to rotate (430, previously shown) about the mount's (310) axis $A_4$ and pivot (440, previously shown) from $A_4$ to $A_5$, about the action block's (300) pivot joint (315, axis $A_3$).

The dampener (350, not visible) provides a resistive force (380) against gravity by compressing (390) in a controlled manner. This causes the firearm (10) to smoothly come to rest in the deployed position (460), with the barrel sight (33) up, and the grip (20) down and projected outward from the storage system (100) for ambidextrous retrieval by a user.

Figure 2A:
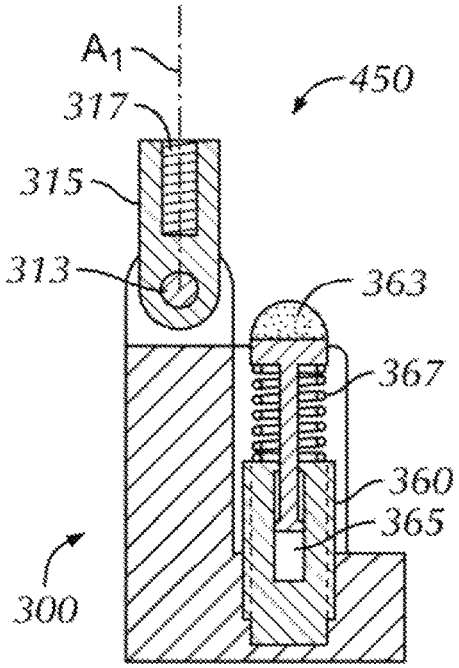
FIG. 2A shows an action block in a stored position in accordance with an exemplary embodiment.

FIG. 2A shows an action block in a stored position in accordance with an exemplary embodiment. The action block (300) connects to the gun mount's (310, not indicated) base (315) is pivotally attached (313). The base (315) has a threaded recess (317) where the desired gun mount (310) is attached.

In some embodiments, the dampener (350, not labeled) is a pneumatic shock absorber (360). The shock absorber (360) comprises a cap (363) retaining a return spring (367) around a shaft of a compression chamber (365). The action block (300) is shown in the stored position (450) where the gun (10) on the gun mount (310) would be oriented substantially vertically as indicated by $A_1$.

Figure 2B:
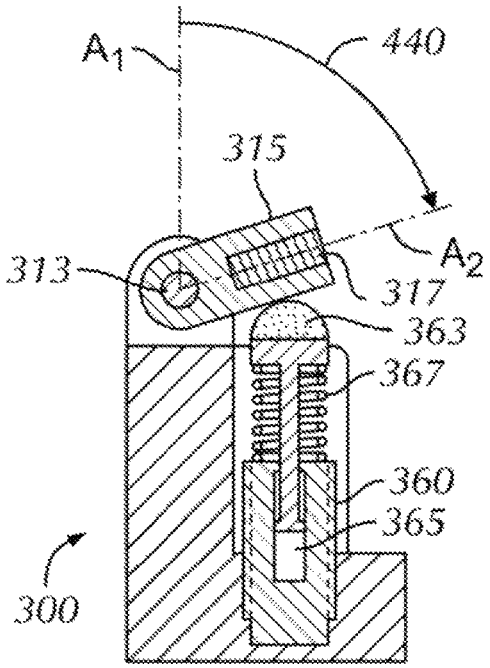
FIG. 2B illustrates compression of a dampener during deployment in accordance with an exemplary embodiment.
Figure 2C:
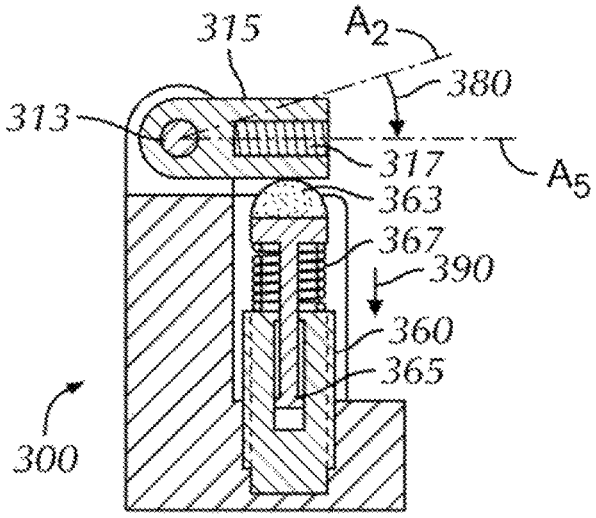
FIG. 2C illustrates compression of a dampener during deployment in accordance with an exemplary embodiment.

FIG. 2B and FIG. 2C illustrate compression of a dampener during deployment in accordance with an exemplary embodiment. As the gun mount's base (315) pivots (440) during deployment, from position $A_1$ toward $A_2$ about the pivot joint (313), the cap (363) of the shock absorber (360) contacts the base (315). As the weight of the gun, with its magazine and ammunition, compresses (390) the shock absorber (360), the resistance of the return spring (367) and the dampening action of the compression chamber (365) provide resistance to decelerate the deployment in the final transition (380) from position $A_2$ toward $A_5$.

Figure 3:
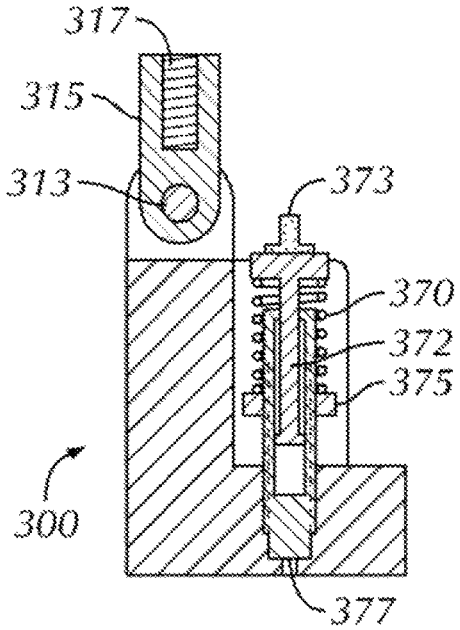
FIG. 3 illustrates an alternative embodiment of a dampener, and adjustment of same in accordance with an exemplary embodiment.

FIG. 3 illustrates an alternative embodiment of a dampener, and adjustment of the same. The action block (300)

connects to the gun mount's (310, not indicated) base (315) and is pivotally attached (313). The base (315) has a threaded recess (317) where the desired gun mount (310) is attached.

In this alternative embodiment, the dampener (350, not labeled) is an adjustable compression spring (370). The assembly comprises a cradle cap (373) toping a movable shaft (372), the distal end of which mates with an optional compression chamber (365). The shaft (372) extends through the center of a wound spring and is contained thereon at the bottom end by an adjustable tensioner (375). An adjustment (377) allows pre-tensioning of the compression spring (370) by raising or lowering the tensioner (375).

One skilled in the art would appreciate that an adjustment could also allow modification of the compression chamber in addition to, or in instead of pre-tensioning the compression spring (370). A proper adjustment would allow the gun (10) to deploy by the effects of gravity, and come to a stable resting position without bounce, or other undue shock, that could damage the weapon or the mount.

Additionally, adjustment could cause the final deployed position of the weapon to be angled above or below horizontal and angling the action block could also move the final deployed position to the left or right of center, depending on the environment and desire of the user. Typically, the final deployed position angle is above horizontal to minimize the risk of the gun sliding off the mount. But in some cases, this risk of sliding may be minimized by, for example, an O-ring as discussed later herein. Sometimes, a final deployed position of the weapon at an angle below the horizontal may be an acceptable risk in view of presenting the weapon to the user at a desired angle.

Figure 4A:
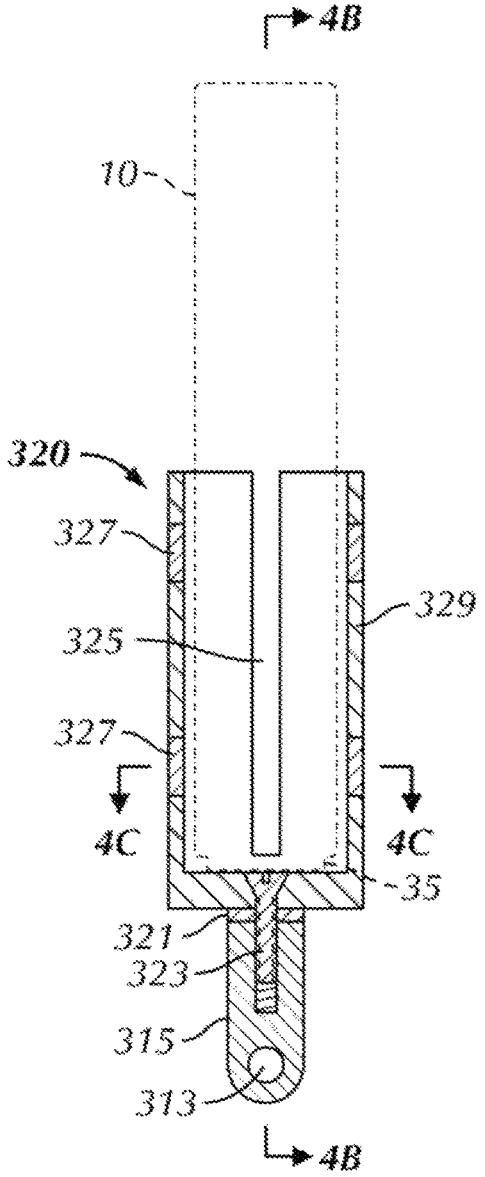
FIGS. 4A, 4B, and 4C illustrate cross sections of a sheath mount in accordance with an exemplary embodiment.
Figure 4B:
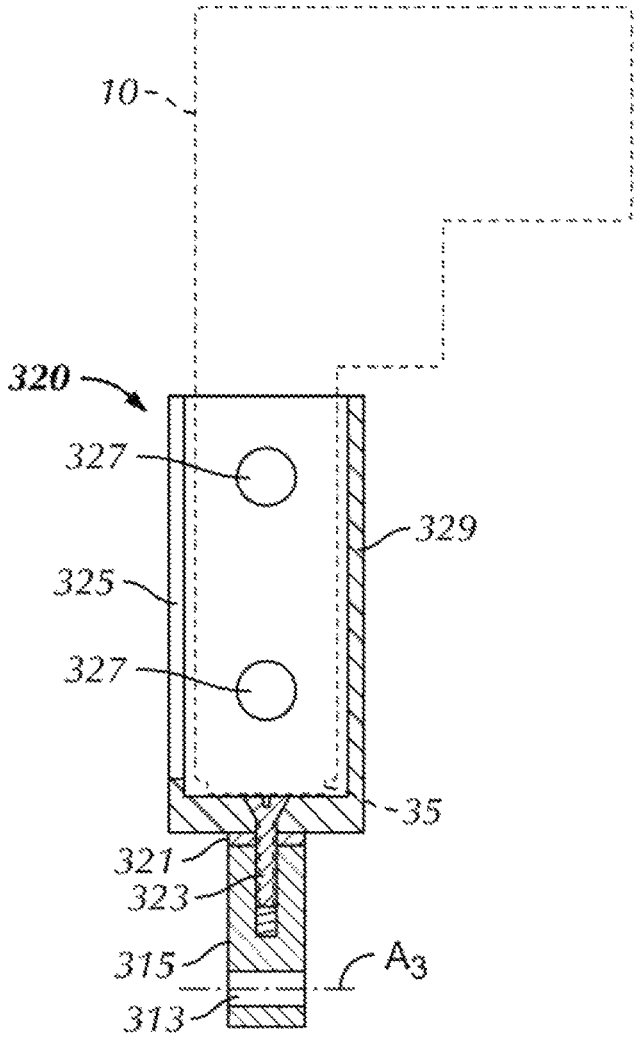
Figure 4C:
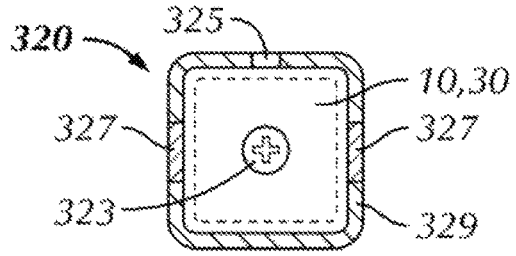

FIGS. 4A, 4B, and 4C illustrate cross sections of a sheath mount in accordance with an exemplary embodiment. The gun mount (310) illustrated is a sheath mount (320) which holds the gun (10) by a sheath (329) which fits around the gun's (10) barrel. The sheath (329) is secured to the mount base (315) opposite the pivot joint (313) by a mounting screw (323), through a washer (321) to allow rotating during deployment.

The sheath (329) may be form fitting, and may compress against the weapon to provide grip, or may optionally include magnets (327) embedded in the sheath material. The sheath may also include a sight clearance (325) to allow tighter fit while preventing damage to the gun's (10) sight. In one embodiment the sheath may be formed from leather. In another embodiment the molded from plastic. In another embodiment, the sheath may be of a metallic material. The sheath is intended to hold the weapon securely during deployment action until drawn by the user. The sheath may enclose the barrel, or optionally may extend such that it abuts the sides of the trigger guard, thus preventing access to the trigger until the gun is drawn from the mount.

Figure 5A:
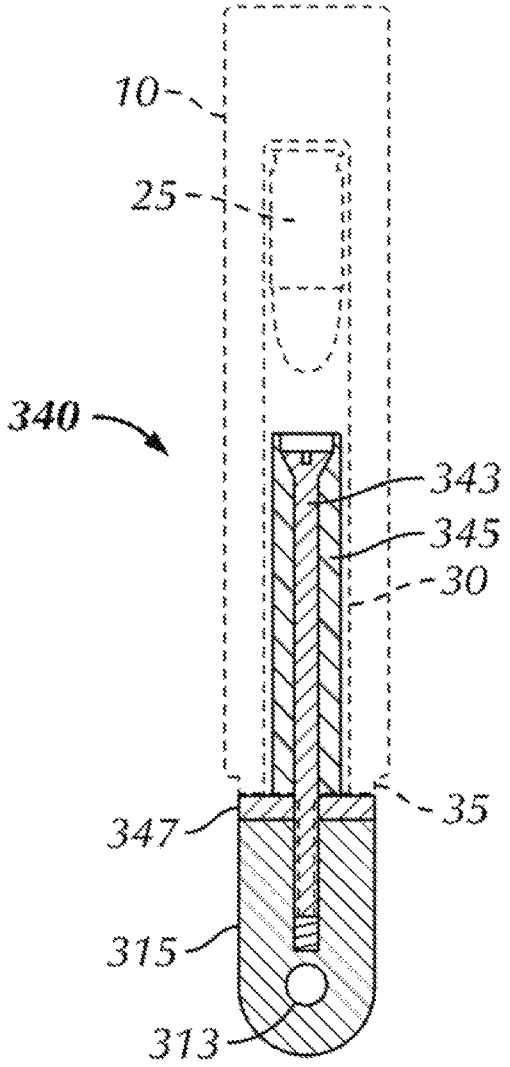
FIGS. 5A, 5B, and 5C illustrate cross sections of a barrel pin mount in accordance with an exemplary embodiment.
Figure 5B:
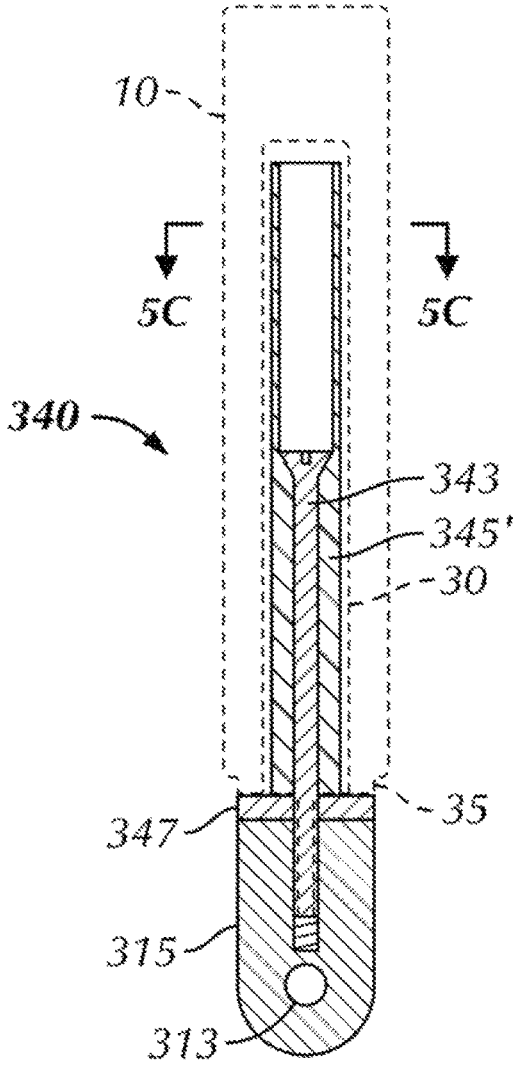
Figure 5C:
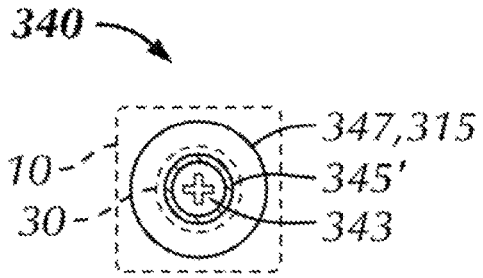

FIGS. 5A, 5B, and 5C illustrate cross sections of a barrel pin mount in accordance with an exemplary embodiment. The gun mount (310) illustrated is a rotating barrel collar mount (340) which holds the gun (10) by extending into the barrel (30) of the gun (10) a barrel collar (345, 345') around an axle/screw (343). The axle/screw (343) extends through the central opening of the barrel collar (345, 345') and passes through a muzzle disk (347) before threading into the threaded recess (317, not labeled) of the mount's base (315) distal to the pivot joint (313). The axle/screw (343) has a head that captures the barrel collar (345, 345') and muzzle disk (347) to the mount base (315) but allows the barrel collar (345, 345') to rotate.

In the stored position, the gun's (10) barrel (30) encloses the barrel collar (345, 345') and the muzzle (35) rests against the muzzle disk (34 7). The short barrel collar (345) allows a chambered round (25) in the mounted gun (10). The long barrel collar (345') prevents the gun (10) from being properly mounted unless the chamber is clear. The outer diameter of the barrel collar (345, 345') is determined by the caliber of the gun (10) and should be substantially the same size as the gun's ammunition (25).

The barrel collar (345, 345') is preferably made of a material that prevents marring of the gun's barrel during mounting or drawing. The barrel collar's (345, 345') inner diameter should allow it to rotate around the axle/screw (343). The muzzle disk (347) is preferably made of a material that prevents marring of the gun's muzzle. In one embodiment, the muzzle disk (347) is made of felt, and the barrel collar (345, 345') is made of nylon or other plastics that are softer than the gun barrel's material. The base (315), axle/screw (343), and action block (300) are machined metal in some embodiments but may be composed of other material which provides the required strength for the deployment action.

Figure 6A:
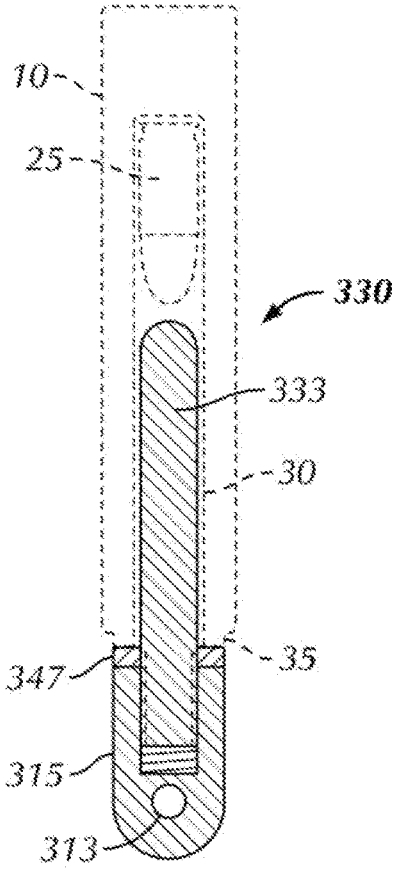
FIGS. 6A, 6B, and 6C illustrate cross sections of an alternative barrel pin mount in accordance with an exemplary embodiment.
Figure 6B:
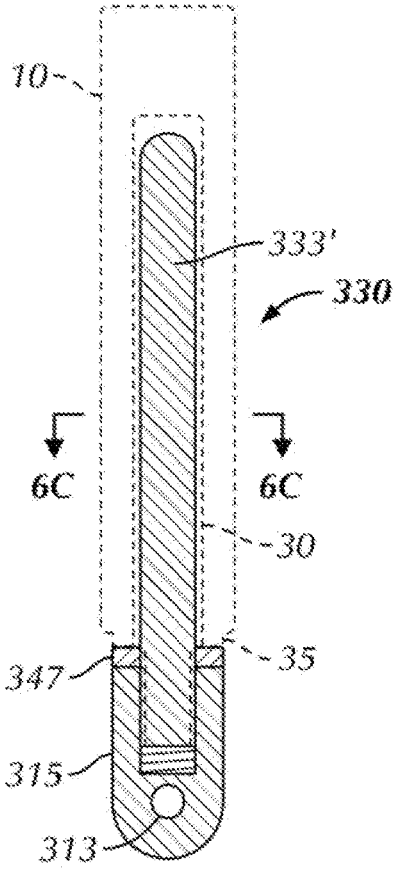
Figure 6C:
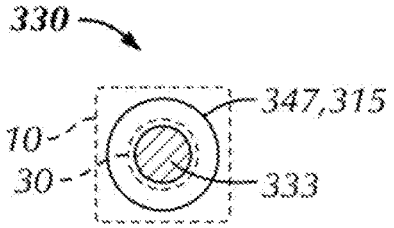

FIGS. 6A, 6B, and 6C illustrate cross sections of an alternative barrel pin mount in accordance with an exemplary embodiment. The gun mount (310) illustrated is a barrel pin (330) which holds the gun (10) by extending into the barrel (30) of the gun (10) a barrel pin (333, 333') that passes through a muzzle disk (347) before threading into the threaded recess (317, not labeled) of the mount's base (315) distal to the pivot joint (313).

In the stored position, the gun's (10) barrel (30) encloses the barrel pin (333, 333') and the muzzle (35) rests against the muzzle disk (347). The short barrel pin (333) allows a chambered round (25) in the mounted gun (10). The long barrel pin (333') prevents the gun (10) from being properly mounted unless the chamber is clear. The outer diameter of the barrel collar (333, 333') is determined by the caliber of the gun (10) and should be substantially the same size as the gun's ammunition (25).

The barrel pin (333, 333') is preferably made of a material that prevents marring of the gun's barrel during mounting or drawing. In this embodiment the barrel pin (333, 333') does not rotate, and is chamfered or rounded at the end opposite the base. The barrel pin (333, 333') is made of carbon fiber or nylon or plastic of substantial strength to support the weapon during deployment action. In an alternative embodiment the barrel pin may have a metallic core to provide additional strength.

Figure 7A:
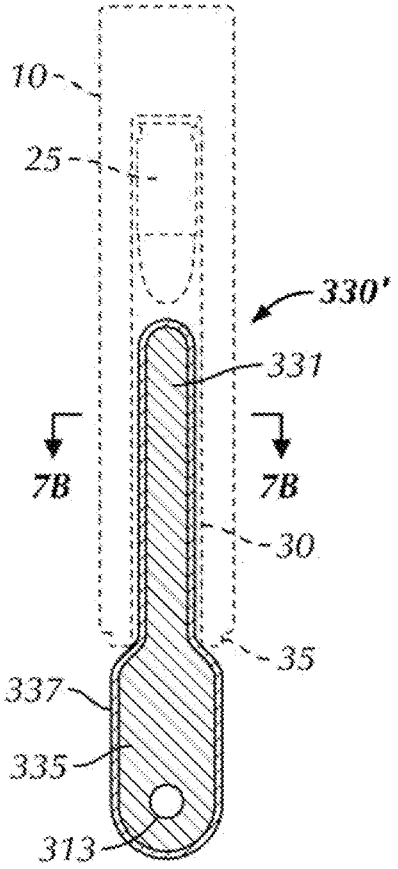
FIGS. 7A and 7B illustrate cross sections of another alternative barrel pin mount in accordance with an exemplary embodiment.
Figure 7B:
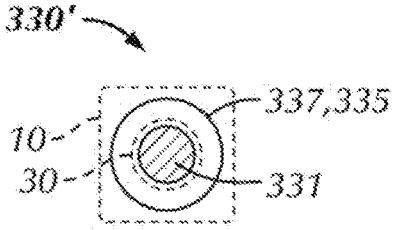

FIGS. 7A and 7B illustrate cross sections of another alternative barrel pin mount in accordance with an exemplary embodiment. The alternative single piece barrel pin mount (330') has a barrel pin (331) which flares out at the base (335). The barrel pin (331) is inserted into the barrel (30) of the gun (10) and the muzzle (35) rest against the edges of the flare between the pin (331) and the base (335). The base has a pivot joint (313) at the end of the base (335) opposite the pin (331). As with other embodiment, the pin (331) may be of different lengths to accommodate chambered rounds (25) or require a cleared weapon. In one embodiment, the barrel pin mount (330') is made from metal and coated (337) with an epoxy, resin, or other material to protect the gun's (10) barrel (30) and muzzle (35) from marring.

Figure 8:
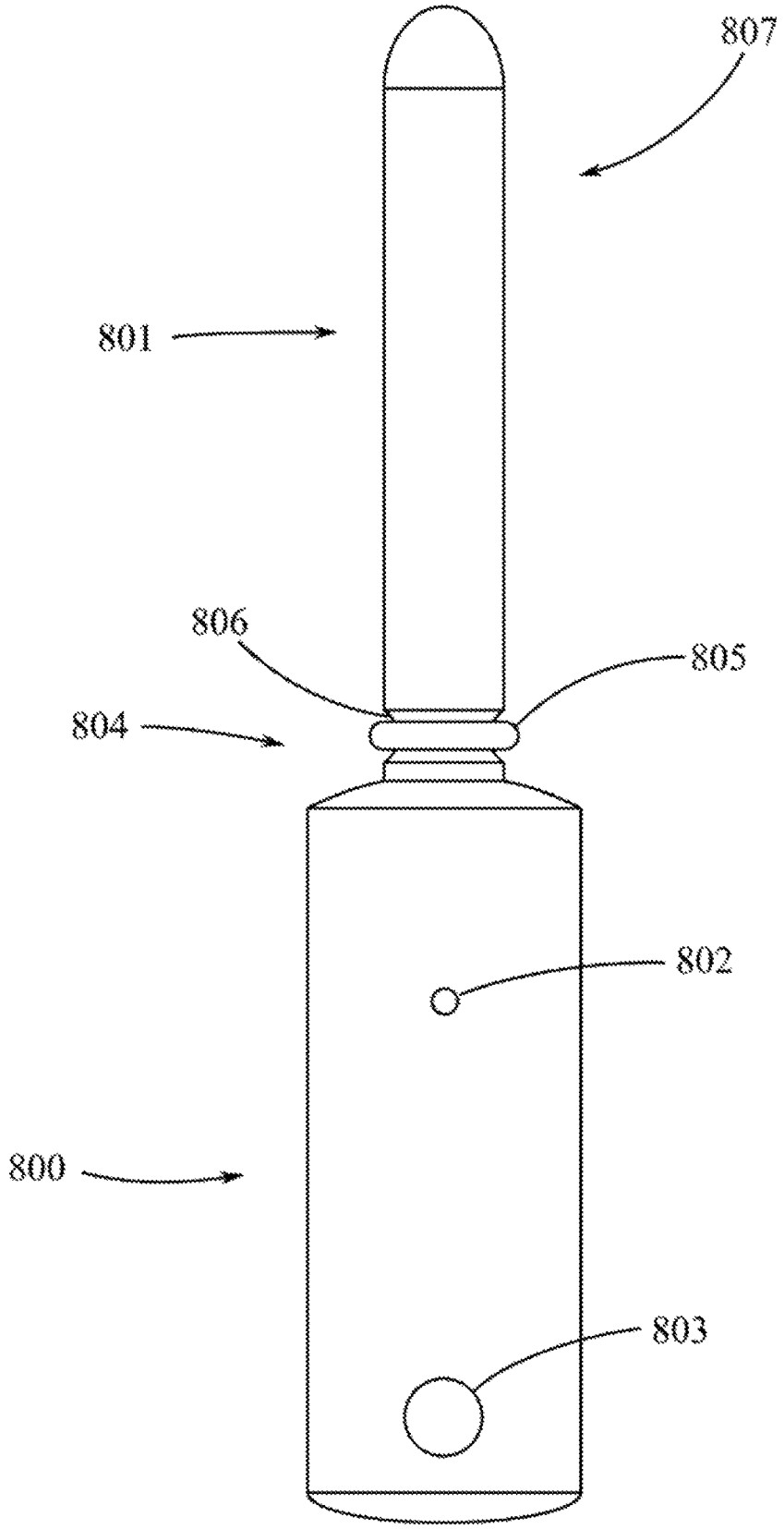
FIG. 8 illustrates an alternative embodiment of a gun mount.

FIG. 8 illustrates a side view of another embodiment of a gun mount (800). The gun mount base (800) has a barrel pin (801) inserted into an opening at the top (804) of the base (800) distal to a pivot joint (803). The top of the barrel pin (801) is tapered (804). The pin (801) is held in place by a metal roller pin (802). The diameter of the pin (801) is such that it can fit into the barrel of a gun similar to the embodiments in FIG. 6A or FIG. 6B. The base (800) connects to an action block (not shown) via the pivot joint (803). An O-ring (805) is installed in a recessed portion (806) of the barrel pin (801) near the top (804) of the base. The portion of the barrel pin (801) that is recessed (806) supports the O-ring, impairing its ability to move along the longitudinal axis of the barrel bin (801) (e.g., so the O-ring is less likely to slide off the end barrel pin (801)). The O-ring (805) creates an interference fit between the gun barrel and the barrel pin so as to better secure the gun in a deployed position.

In FIG. 8, the gun mount base (800) is preferably made of a sturdy plastic such as Delrin® so as to reduce the need for a muzzle disk by minimizing interaction with the end of the gun so as to reduce the likelihood of cosmetic or structural damage to the gun. But in some embodiments, a muzzle disk may still be present.

In FIG. 8, the barrel pin (801) is preferably made of carbon fiber. Carbon fiber has shown to be the ideal material for a barrel pin for several reasons. First, it is substantially softer than the metal of a gun's barrel and to the longitudinal axis of a gun barrel, the gun can be placed and removed repeatedly with little or no effect on the inside of the barrel. This contrasts with softer metals such as brass which has the potential to scratch or wear down the inside of the barrel.

Also, when placing the gun on the barrel pin, user error may lead to a failed insertion attempt leading to an impact between the front of the gun (and/or front of the gun's barrel) and the barrel pin (801). This can cause at least cosmetic damage to the gun if the barrel pin is metal, but that risk is far less if the barrel pin is carbon fiber. (The taper (807) at the top of the barrel pin (801) may also minimize the risk of damage, but the taper (807) is not strictly necessary.) Second, the carbon fiber material is substantially stronger than plastic or fiberglass or metal alternatives and can endure far more "drops" (i.e., a change from a stored position to a deployed position). A failure of the barrel pin (801) during deployment could have a significant, negative impact on the user. Third, the weight of the carbon fiber pin reduces the weight of the overall product and also the weight impacting the action block and/or dampener.

In FIG. 8, the O-ring is typically made of rubber, but hard or soft plastics or soft metals may be used. The O-ring is not strictly necessary, and for some guns, an interference fit between the O-ring and the barrel would not be desirable. In other cases, two or three or more O-rings and recessed portions along the carbon fiber pin may be used to increase friction forces.

In FIG. 8, the roller pin (802) is made of metal. In some embodiments, glue, epoxy, screws, or other pins (e.g., a cotter pin) may be used to secure the barrel pin (801) to the base (800). In some embodiments, the barrel pin (801) may be threaded into the base (800) similar to FIG. 6A. In some embodiments, the barrel pin (801) and the base (800) may be an integral unit.

Figure 9:
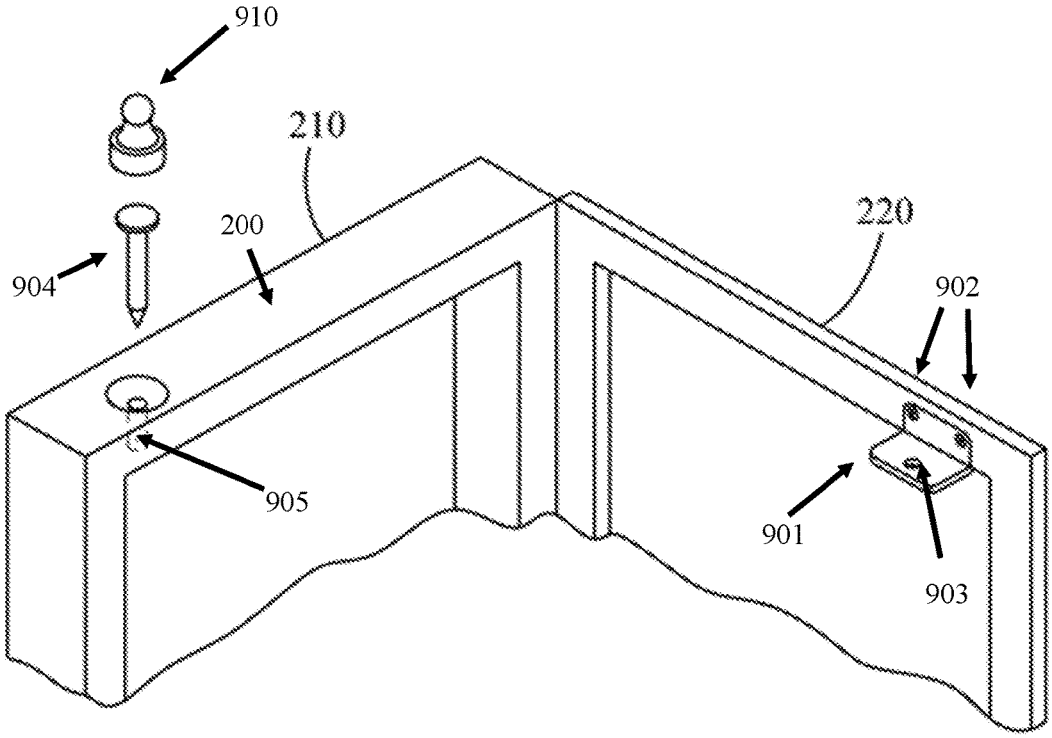
FIG. 9 illustrates a storage system utilizing a hole and bracket and a pin.

In FIG. 9, a bracket (901) has been attached to aback side of the front panel (220). The top of the bracket may in some instances be inset flush with the plane of the back of the front panel (220). In other instances, it may be inset recessed or protruding. The bracket (901) has holes (902) for attachment via bolts or screws to the front panel (220). In other embodiments, the bracket (901) may be formed from the front panel (220) material or be glued or epoxied or welded in place. In FIG. 9, the bracket (901) has been attached near the top of the back side of the front panel (220). While a top-oriented, front panel embodiment in shown in FIG. 9, the bracket (901) may be attached to an internal or external side or bottom or top of the front panel (220) or frame (220).

The bracket (901) has an opening (903) to receive a pin (904). When the front panel (220) is in a closed position, the pin (904) may be inserted into and through a hole (905) in the frame (200). The hole (905) in the frame (200) is aligned with the opening (903) of the bracket (901) when the front panel is in a closed position. Once inserted through the hole (905) and into the opening (903) of the bracket (901), the pin then impedes the ability of the front panel (220) to open. Thus, the removable pin (904) fixes the front panel (220) to the frame (200) by way of the hole (905) and the bracket (901). The pin (904) may then be removed from, at least, the opening (903) to stop the impeding of the opening of the front panel (220). The hole (905) in the frame (200) may be recessed or countersunk so as to allow the pin (904) to sit flush, or sit below flush, with the top of the frame (200). In other embodiments, the pin (904) may protrude above the top of the frame (200). A picker (910) may be used to remove the pin (904) as discussed later.

Just as the bracket (901) may be mounted, in some embodiments, may be attached to an internal or external side or bottom or top of the front panel (220), so also the hole (905) may be on a side or the bottom of the frame (200). Or the locations of the bracket (901) and hole (905) may be reversed, with the hole in the front panel and the bracket attached to the frame. The particular location and angular orientation of either the hole (905) or the bracket (901) are not important, so long as a pin of sufficient length and shape is able to enter the hole (905) and the opening (903) of the bracket (901) so as to impede the ability of the front panel (220) to open and thereby keeping the storage system in a stored position. In some embodiments, for example where gravity may cause the pin to fall out, the pin may be friction fit into the hole (903) and/or opening (903), and/or the pin (904) may be magnetically attracted to the bracket, and/or the hole (903) may be angled (e.g., not perpendicular) with respect to the frame (200) or front panel (220) so as to increase the friction forces that impair the movement of the pin (904).

The pin need not always have a head, for example, in embodiments where the opening in the bracket does not fully pass through the entire thickness of the bracket or where the pin's path of travel has a physical backstop impeding further progress, or the pin may have, for example, a conical shape and the hole may have a cylindrical shape narrower than or equal to the conical base of the pin so thereby the pin's movement may be impaired along its path of travel. In other cases, the pin and/or a pin head protrudes above the frame (200) so it may be removed by a hand.

Figure 10:
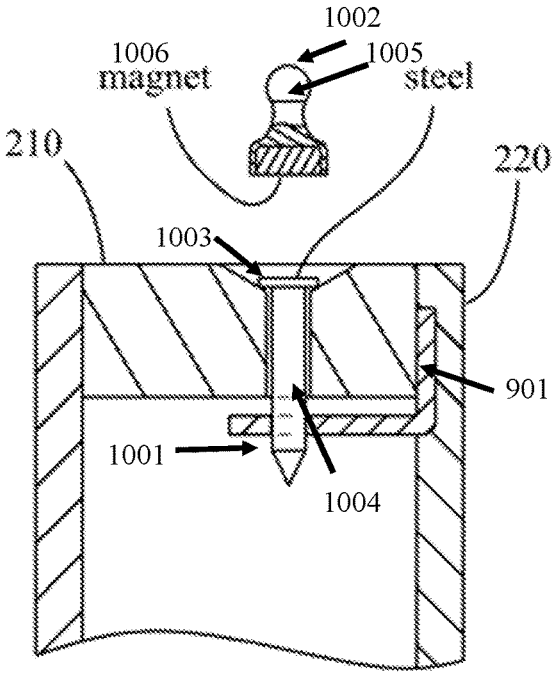
FIG. 10 illustrates a pin and a picker.

In FIG. 10, a pin (1001) and magnetic picker (1002) are shown. The pin (1001) has a head (1003) and a shaft (1004). In this embodiment, the shaft (1004) is at least long enough to enter both the hole (905) and the opening (903) of the bracket (901). In this embodiment, at least the head (1003) of the pin (1001) is a metal (e.g., iron or steel) that is attracted to a magnet so that the magnetic picker (1002) can be manipulated into close proximity of the pin (1001) and lift the pin (1001) out of at least the opening (903) of the bracket (901). The magnetic picker (1002) has a body (1005) (made of brass or wood or plastic or other material) and a magnet (1006) affixed to, or embedded within, the body (1005). In other embodiments, the entire magnetic picker (1002) is a magnet. The magnet (1006) is strong enough so as to attract the pin (1001) with sufficient force so as to enable a user to remove the pin (1001) from, at least, the opening (903) to stop the impediment of the opening of the front panel (220). In other embodiments, the pin may be removed from both the opening (903) and the hole (905) of the bracket (901).

Figure 11:
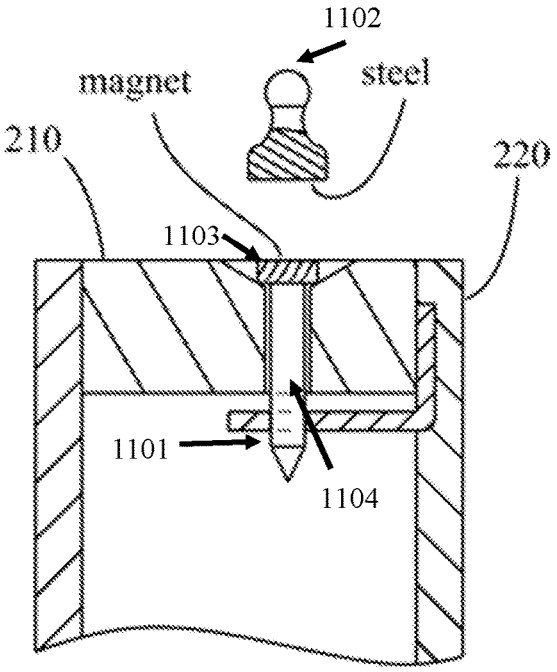
FIG. 11 illustrates an alternative pin and picker embodiment.

In FIG. 11, another pin embodiment is shown. The head (1103) of the pin (1101) is a magnet, and the picker (1102) comprises a metal (e.g., iron or steel) that is attracted to the head (1103) of the pin (1101). The shaft (1104) of the pin (1101) may be threaded in, glued, epoxied, welded, or otherwise affixed to, or integrally formed with, the head (1103). In embodiments where the head of the pin is a magnet, a specially adapted picker may not be needed. An item comprising iron (e.g., an iron key or ring or bar) or another magnet or magnetic metal may be used to lift the pin (1101) out of at least the opening (903) of the bracket (901). Alternatively, the entire pin may be magnetic. In a preferred embodiment, the head of the pin is a rare earth magnet.

In some alternative embodiments, the pin is a breakaway pin made of glass or plastic or other breakable material that shatters when subjected to a sufficient force perpendicular to the longitudinal axis of the pin. In some embodiments, the pin may be manually insertable and/or removable. The thickness of the pin may also vary depending on the application and desired strength.

In other embodiments, the frame and the front panel may each have holes. For example, the front panel may recess into the frame in a storage position, or the front panel may partially envelop the frame in a storage position. In such circumstances, the holes may align in a stored position so as to allow a pin to enter each of them thereby impeding the opening of the front panel when the pin is present. In some cases, the two holes only align in a stored position, and in some cases, the two holes are not aligned in a deployed position.

In some embodiments, the front panel may be secured to the frame by a sliding latch, or a hook and eye latch, or a spring-loaded locking pin, or a cabinet cam lock, or a biometric lock, or an RFID lock.

The diagrams in accordance with exemplary embodiments are provided as examples and should not be construed to limit the scope of the claims. For instance, heights, widths, and thicknesses may not be to scale and should not be construed to limit the claims to the particular proportions illustrated. Some elements illustrated in the singularity may actually be implemented in a plurality, and some elements illustrated in the plurality may vary in count. Elements illustrated in one form could vary in detail. Additionally, Specific numerical data values (such as specific quantities, numbers, categories, etc.) or other specific information should be interpreted as illustrative for discussing exemplary embodiments, and not as limiting the claims.

The above discussion is meant to be illustrative of the principles and various embodiments. Numerous variations and modifications will become apparent to those skilled in the art once the above disclosure is fully appreciated. It is intended that the following claims be interpreted to embrace all such variations and modifications.

What is claimed is:

1. An apparatus for deployment of a gun comprising:

an enclosure comprising a front panel and a frame, the frame comprising a hole;

an action block attached to the enclosure, the action block comprising:

a shaft, and a return spring supporting the shaft:

a base, the base pivotably attached to the action block and capable of pivotably transitioning between:

a stored position, and a deployed position; and a bracket attached to the front panel, the bracket having an opening, the bracket capable of aligning with the hole in the frame so as to permit a removable pin to enter both the hole and the opening of the bracket, thereby impeding opening of the front panel.

2. The apparatus of claim 1 comprising a barrel pin attached to the base.

3. The apparatus of claim 2 wherein the barrel pin is a carbon fiber barrel pin.

4. The apparatus of claim 2 wherein the barrel pin comprises an O-ring for creating an interference fit between the barrel pin and a gun barrel.

5. The apparatus of claim 2 where a portion of the barrel pin is recessed so as to impair an O-ring's movement along the longitudinal axis of the barrel pin.

6. The apparatus of claim 1 further comprising the removable pin, wherein the removable pin comprises iron.

7. The apparatus of claim 6 further comprising a picker for lifting the removable pin using magnetic attraction, the picker comprising a magnet.

8. The apparatus of claim 1 wherein the enclosure further comprises a back panel and wherein the action block is attached to the back panel.

* * * * *